US009450296B2

(12) United States Patent
Lin

(10) Patent No.: US 9,450,296 B2
(45) Date of Patent: Sep. 20, 2016

(54) ANTENNA STRUCTURE AND WIRELESS COMMUNICATION DEVICE USING THE SAME

(71) Applicant: Chiun Mai Communication Systems, Inc., New Taipei (TW)

(72) Inventor: Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 145 days.

(21) Appl. No.: 14/524,444

(22) Filed: Oct. 27, 2014

(65) Prior Publication Data

US 2015/0188213 A1 Jul. 2, 2015

(30) Foreign Application Priority Data

Dec. 30, 2013 (CN) ..... 2013 1 0742071

(51) Int. Cl.
*H01Q 1/24* (2006.01)
*H01Q 1/38* (2006.01)
*H01Q 5/371* (2015.01)

(52) U.S. Cl.
CPC ..... *H01Q 1/243* (2013.01); *H01Q 1/38* (2013.01); *H01Q 5/371* (2015.01)

(58) Field of Classification Search
CPC ..... H01Q 5/371; H01Q 1/38
See application file for complete search history.

(56) References Cited

U.S. PATENT DOCUMENTS

2008/0246674 A1* 10/2008 Rutfors ..... H01Q 1/243 343/722
2011/0156958 A1* 6/2011 Wong ..... H01Q 1/243 343/700 MS
2012/0001827 A1* 1/2012 Chen ..... H01Q 9/0471 343/908
2013/0063311 A1* 3/2013 Huang ..... H01Q 1/243 343/700 MS
2013/0241800 A1* 9/2013 Schlub ..... H01Q 1/243 343/893
2014/0139379 A1* 5/2014 Bolin ..... H01Q 1/243 343/702
2014/0145892 A1* 5/2014 Tseng ..... H01Q 1/38 343/750

* cited by examiner

*Primary Examiner* — Hoang V Nguyen
*Assistant Examiner* — Michael Bouizza
(74) *Attorney, Agent, or Firm* — Zhigang Ma

(57) ABSTRACT

An antenna structure includes a feed end, a first radiator plate, a second radiator plate, a third radiator plate, a first ground end, and a second ground end. The first radiator plate and the third radiator plate are coupled to the feed end. The second radiator plate is coupled to the first radiator plate. The first ground end and the second ground end are disposed on the third radiator plate and are spaced from the first ground end. The first ring portion is coupled to the first radiator plate, the second radiator plate, and the third radiator plate.

20 Claims, 5 Drawing Sheets

ANTENNA STRUCTURE AND WIRELESS COMMUNICATION DEVICE USING THE SAME

FIELD

The disclosure generally relates to antenna structures, and particularly to a multiband antenna structure, and a wireless communication device using the same.

BACKGROUND

Antennas are used in wireless communication devices such as mobile phones. The wireless communication device uses a multiband antenna to receive/transmit wireless signals at different frequencies, such as wireless signals operated in an long term evolution (LTE) band.

BRIEF DESCRIPTION OF THE DRAWINGS

Implementations of the present technology will now be described, by way of example only, with reference to the attached figures.

DETAILED DESCRIPTION

Figure 1:
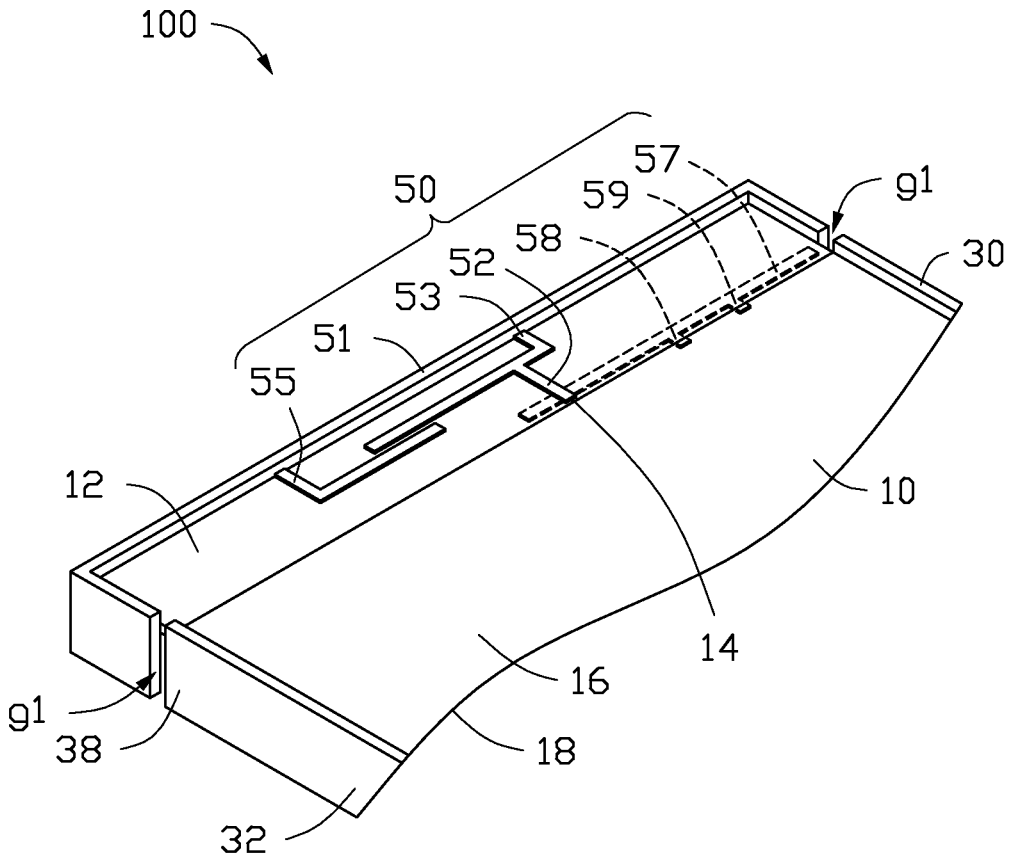
FIG. 1 is an isometric view of a wireless communication device employing an antenna structure, according to an exemplary embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to an antenna structure and a wireless communication device using same.

Figure 2:
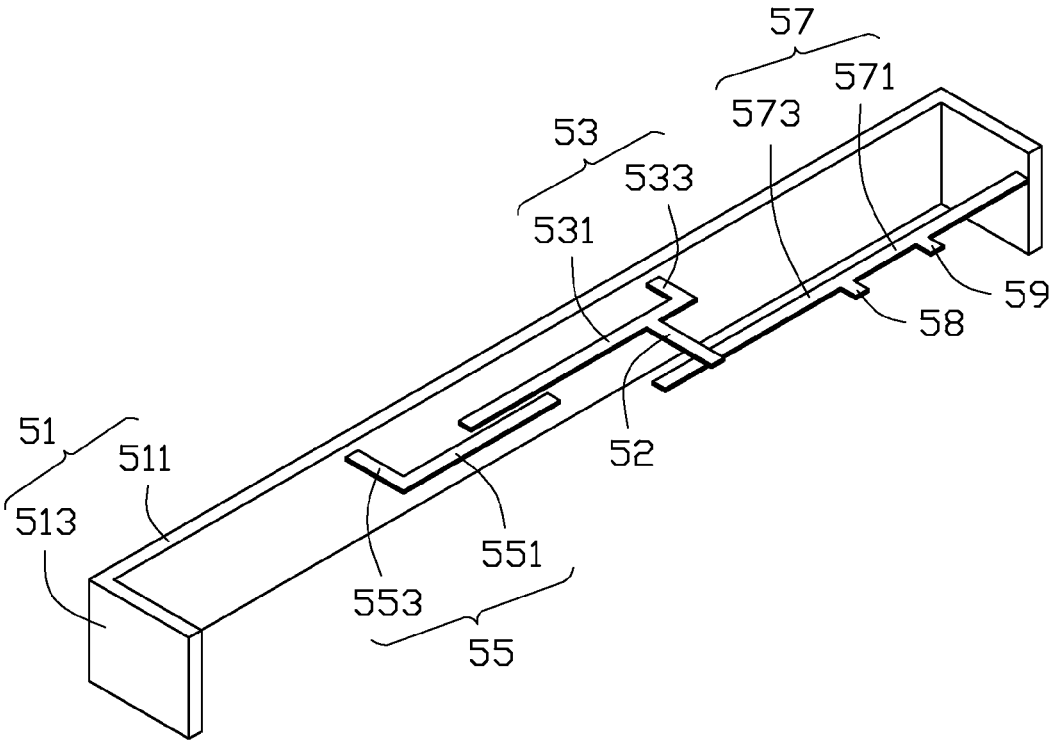
FIG. 2 is an isometric view of the antenna structure of FIG. 1.

FIGS. 1-2 illustrate an embodiment of a wireless communication device 100 employing an antenna structure 50, according to an exemplary embodiment. The wireless communication device 100 can be a mobile phone, a tablet, or an intelligent watch, for example (details not shown). The wireless communication device 100 further includes a baseboard 10 and a housing 30 surrounding the baseboard 10 and separating from the antenna structure 50. In this embodiment, the housing 30 may be a metal frame or a metal ring including a first ring portion 51 and a second ring portion 32. The first ring portion 51 and the second ring portion 32 are spaced by two gaps g1. The first ring portion 51 may be a part of the antenna structure 50. In at least one embodiment, both the first ring portion 51 and the second ring portion 32 are U-shaped metal sheets.

The baseboard 10 can be a printed circuit board (PCB) of the wireless communication device 100. The baseboard 10 is surrounded by the second ring portion 32 and forms a keep-out-zone 12. The purpose of the keep-out-zone 12 is to delineate an area on the baseboard 10 in which other electronic components (such as a camera, a vibrator, a speaker, etc.) cannot be placed. In at least one embodiment, the keep-out-zone 12 is disposed on an end of the baseboard 10. A feed pin 14 is formed on the keep-out-zone 12 to provide current to the antenna structure 50.

The antenna structure 50 includes the first ring portion 51, a feed end 52, a first radiator plate 53, a second radiator plate 55, a third radiator plate 57, a first ground end 58, and a second ground end 59. The feed end 52, the first radiator plate 53, and the second radiator plate 55 are disposed on a first surface 16 of the baseboard 10, the third radiator plate 57, the first ground end 58, and the second ground end 59 are disposed on a second surface 18 of the baseboard 10.

The first ring portion 51 may be a metallic sheet and surrounds a side of the baseboard 10. Also referring to FIG. 2, the first ring portion 51 includes a main portion 511 and two side portions 513 symmetrically and perpendicularly connected to two opposite sides of the main portion 511. The second ring portion 32 of the housing 30 includes two distal ends 38 aligned with the two side portions 513, and the two gaps g1 are respectively defined between each of the two side portions 513 and a corresponding distal end 38 of the housing 30. In at least one embodiment, a width of the gap g1 can be about 1.5 mm.

The feed end 52 is disposed on the baseboard 10 and is coupled to the feed pin 14 to receive current.

The first radiator plate 53 includes a first radiation sheet 531 and a first connection sheet 533. The first radiation sheet 531 is perpendicularly connected to the feed end 52 and extends parallel to the main portion 511. The first connection sheet 533 is substantially an L-shaped sheet, a first end of the first connection sheet 533 is connected to a junction of the first radiation sheet 531 and the feed end 52, and a second end of the first connection sheet 533 is perpendicularly connected to the main portion 511.

The second radiator plate 55 is connected to the first ring portion 51 and is spaced from the first radiator plate 53. In at least one embodiment, the second radiator plate 55 is substantially an L-shaped sheet, and includes a second radiation sheet 551 and a second connection sheet 553. The second radiation sheet 551 is parallel to the first radiation sheet 531 and extends towards the feed end 52. The second connection sheet 553 is perpendicularly connected between the second radiation sheet 551 and the main portion 511.

The third radiator plate 57 includes a third radiation sheet 571 and a coupling sheet 573 extending opposite to the third radiation sheet 571. The third radiation sheet 571 is perpendicularly connected to one of the two side portions 513, and the coupling section 573 is perpendicularly disposed below the feed end 52.

The first ground end 58 and the second ground end 59 are perpendicularly connected to the third radiator plate 57 and separate from each other. The first ground end 58 is perpendicularly connected to an end of the third radiation sheet 571 adjacent to the coupling sheet 573. The second ground end 59 is perpendicularly connected to a middle of the third radiation sheet 571. In addition, a switching circuit (not shown) can be switched to the first ground end 58 or the second ground end 59, thereby grounding the antenna structure 50 via the first ground end 58 or the second ground end 59.

Figure 3:
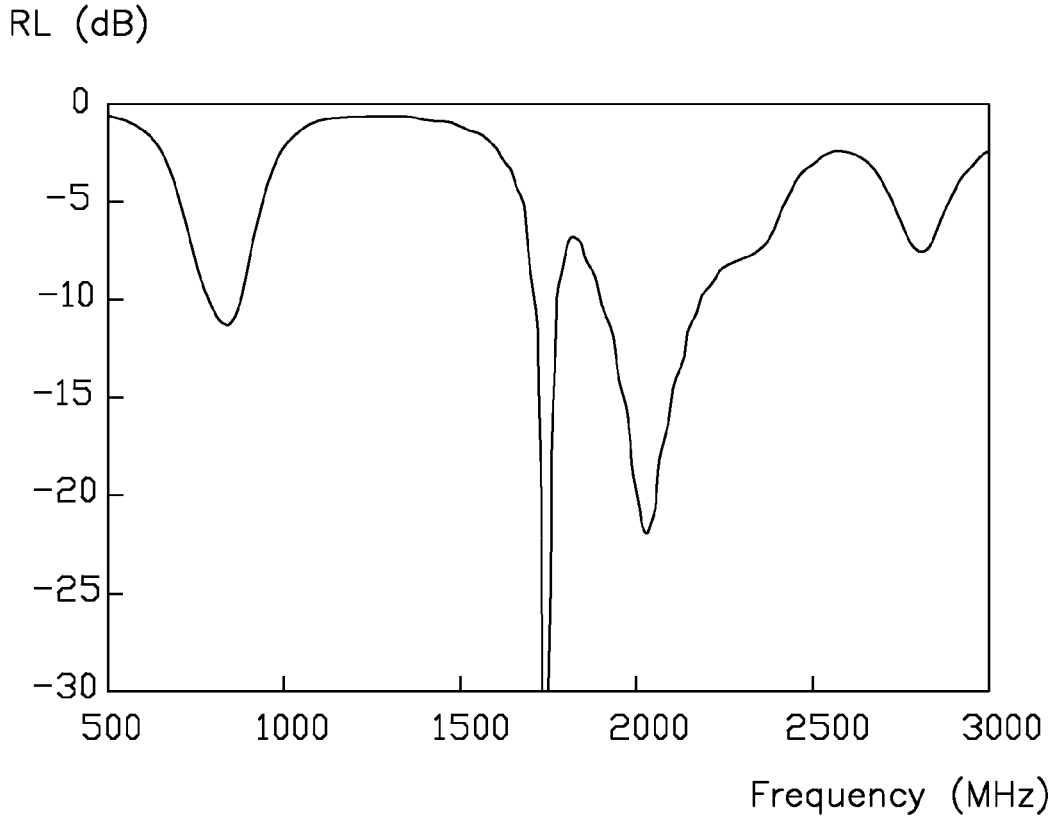
FIG. 3 is a return loss (RL) graph of the antenna structure of FIG. 1, while the antenna structure is coupled to a first ground pin.

When the first ground end 58 is grounded and current is input to the feed pin 14, the current flows to the first radiator plate 53, and is electronically coupled to the second radiator plate 55, the main portion 511, the two side portion 513, and the third radiator plate 57 to form a first current path for resonating a low frequency mode. Additionally, the current flows to first radiation sheet 531, and is electronically coupled the second radiator plate 55 to form a second current path for resonating a first high frequency mode. Furthermore, the current flows to the first connection sheet 533, the main portion 511, the two side portions 513, and the third radiation sheet 571 to form a third current path for resonating a second high frequency mode. Moreover, the current flows to the coupling sheet 573 and the first ground end 58 to form a fourth current path for resonating a third high frequency mode. In at least one embodiment, a central frequency of the low frequency mode can be, for example, about 830 MHz, a central frequency of the first high frequency mode can be, for example, about 1760 MHz, a central frequency of the second high frequency mode can be, for example, about 2030 MHz, and a central frequency of the third high frequency mode can be, for example, about 2300 MHz. FIG. 3 illustrates a return loss (RL) of the antenna structure 50. In view of a RL curve shown on the FIG. 3, the wireless communication device 100 has good performance when operating at 704-960 MHZ and 1710-2300 MHZ.

Figure 4:
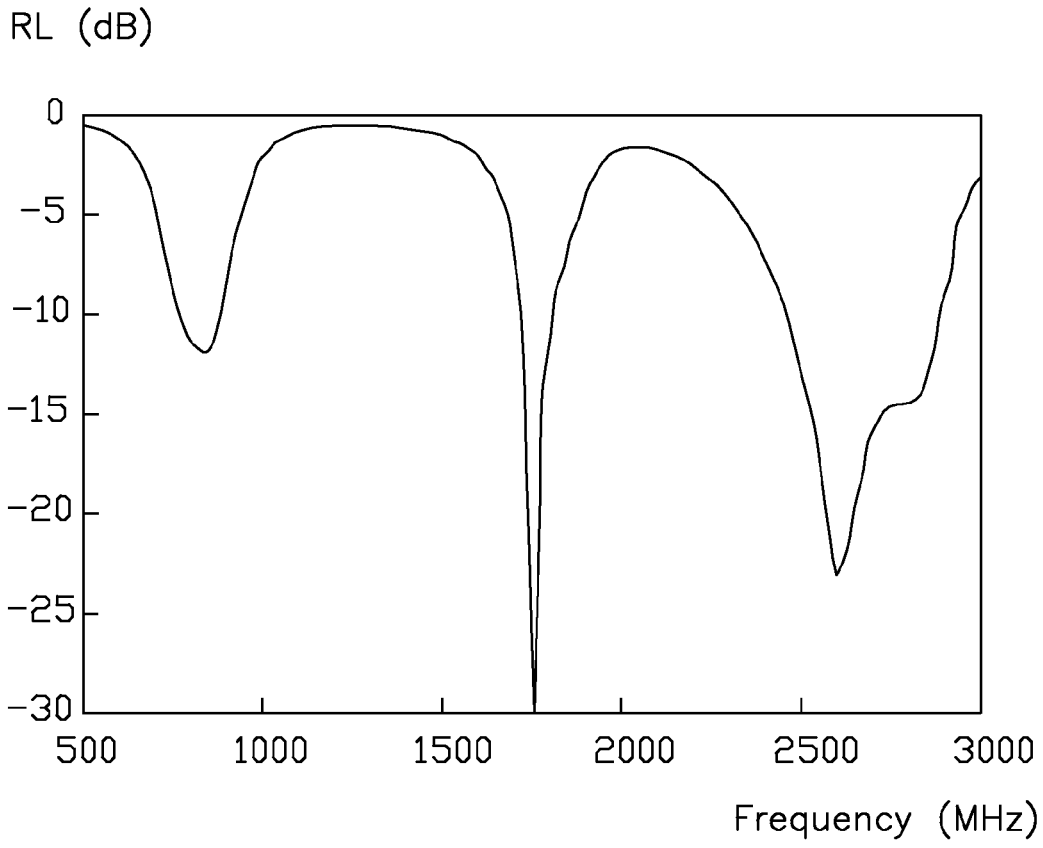
FIG. 4 is a return loss (RL) graph of the antenna structure of FIG. 1, while the antenna structure is coupled to a second ground pin.

When the second ground end 59 is grounded, lengths of the first current path and the second current path are not changed, a length of the third current path is decreased, and a length of the fourth current path is increased. Thus, a total length of the current path is decreased to broaden operating frequencies of the wireless communication device 100. Referring to FIG. 4, since the length of the third current path is significantly changed, the wireless communication device 100 can also operate at 2300-2710 MHZ.

Figure 5:
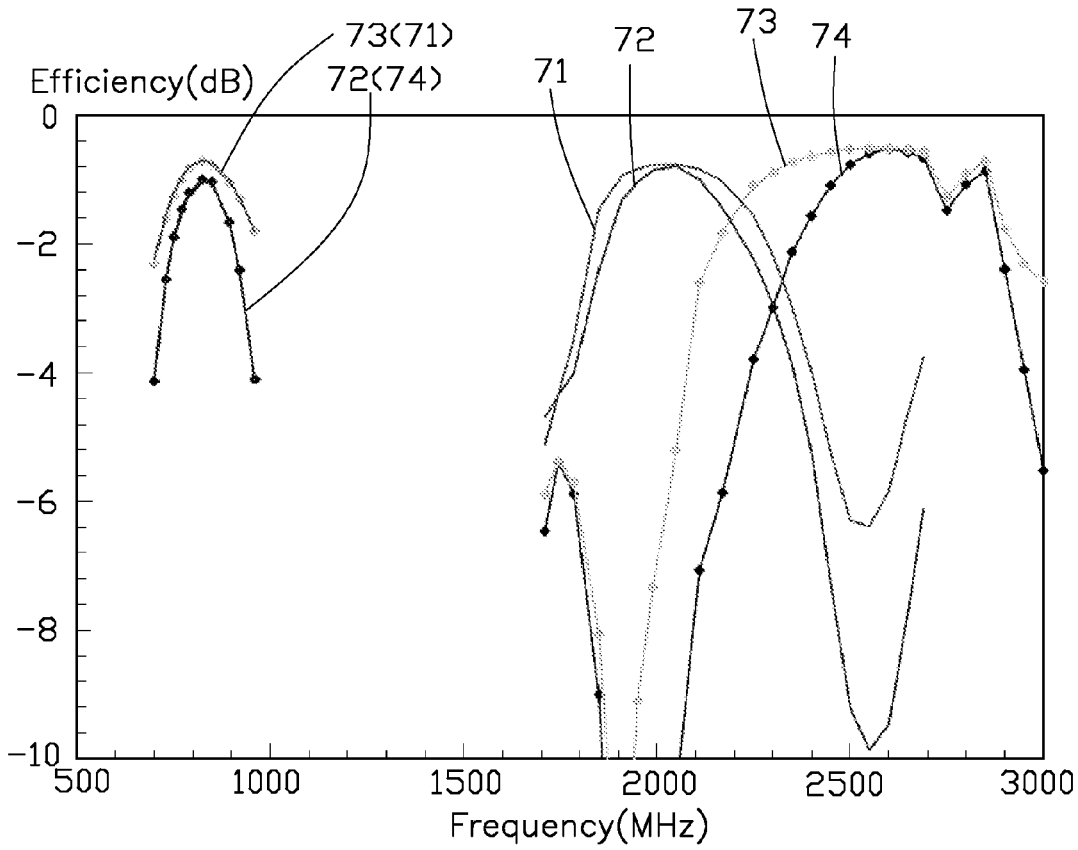
FIG. 5 is an antenna efficiency graph of the antenna structure of FIG. 1.

FIG. 5 is an antenna efficiency graph of the antenna structure 50. A first antenna efficiency curve 71 indicates an ideal efficiency when the first ground end 58 is grounded. A second antenna efficiency curve 72 indicates an total efficiency when the first ground end 58 is grounded. A third antenna efficiency curve 73 indicates an ideal efficiency when the second ground end 59 is grounded. A fourth antenna efficiency curve 74 indicates an total efficiency when the second ground end 59 is grounded. In view of the curves 71-74, the antenna structure 50 has good performance when the central frequency is about 704-960 MHZ and 2300-2710 MHZ.

In summary, the first radiator plate 53, the second radiator plate 55, and the third radiator plate 57 are coupled to the first ring portion 51 to allow the first ring portion 51 to serve as a part of the antenna structure 50, which allows further size reductions of the wireless communication device 100 employing the antenna structure 50. In addition, the first radiator plate 53 is coupled to the second radiator plate 55, the third radiator plate 57 is coupled to the feed end 52, and the antenna structure 50 can be grounded via the first ground end 58 or the second ground end 59. Thus, the wireless communication device 100 can receive/transmit dual-band wireless signals or multiband wireless signals, and a radiating capability of the antenna structure 50 of the wireless communication device 100 is effectively improved because of the first ground end 58 and the second ground end 59.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure, comprising:
- a feed end;
- a first radiator plate coupled to the feed end;
- a second radiator plate;
- a third radiator plate coupled to the feed end;
- a first ground end disposed on the third radiator plate;
- a second ground end disposed on the third radiator plate and spaced from the first ground end; and
- a first ring portion coupled to the first radiator plate, the second radiator plate, and the third radiator plate.

2. The antenna structure as claimed in claim 1, wherein the first ring portion comprises a main portion and two side portions symmetrically and perpendicularly connected to two opposite sides of the main portion.

3. The antenna structure as claimed in claim 2, wherein the first radiator plate is connected between the main portion and the feed end.

4. The antenna structure as claimed in claim 3, wherein the first radiator plate comprises a first radiation sheet and a first connection sheet, the first radiation sheet is perpendicularly connected to the feed end and extends parallel to the main portion, a first end of the first connection sheet is connected to a junction of the first radiation sheet and the feed end, and a second end of the first connection sheet is perpendicularly connected to the main portion.

5. The antenna structure as claimed in claim 4, wherein the second radiator plate comprises a second radiation sheet and a second connection sheet, the second radiation sheet is parallel to the first radiation sheet and extends towards the feed end, and the second connection sheet is perpendicularly connected between the second radiation sheet and the main portion.

6. The antenna structure as claimed in claim 2, wherein the third radiator plate comprises a third radiation sheet and a coupling sheet extending opposite to the third radiation sheet, the third radiation sheet is perpendicularly connected to one of the two side portions, the coupling sheet is perpendicularly disposed below the feed end.

7. The antenna structure as claimed in claim 6, wherein the first ground end is perpendicularly connected to an end of the third radiation sheet adjacent to the coupling sheet, the second ground end is perpendicularly connected to the third radiation sheet.

8. A wireless communication device comprising an antenna structure, the antenna structure comprising:

a feed end;

a first radiator plate coupled to the feed end;

a second radiator plate;

a third radiator plate coupled to the feed end;

a first ground end disposed on the third radiator plate;

a second ground end disposed on the third radiator plate and spaced from the first ground end; and a first ring portion coupled to the first radiator plate, the second radiator plate, and the third radiator plate;

wherein the first ring portion is a part of a housing of the wireless communication device.

9. The wireless communication device as claimed in claim 8, wherein the first ring portion comprises a main portion and two side portions symmetrically and perpendicularly connected to two opposite sides of the main portion.

10. The wireless communication device as claimed in claim 9, wherein the first radiator plate is connected between the main portion and the feed end.

11. The wireless communication device as claimed in claim 10, wherein the first radiator plate comprises a first radiation sheet and a first connection sheet, the first radiation sheet is perpendicularly connected to the feed end and extends parallel to the main portion, a first end of the first connection sheet is connected to a junction of the first radiation sheet and the feed end, and a second end of the first connection sheet is perpendicularly connected to the main portion.

12. The wireless communication device as claimed in claim 11, wherein the second radiator plate comprises a second radiation sheet and a second connection sheet, the second radiation sheet is parallel to the first radiation sheet and extends towards the feed end, and the second connection sheet is perpendicularly connected between the second radiation sheet and the main portion.

13. The wireless communication device as claimed in claim 9, wherein the third radiator plate comprises a third radiation sheet and a coupling sheet extending opposite to the third radiation sheet, the third radiation sheet is perpendicularly connected to one of the two side portions, the coupling sheet is perpendicularly disposed below the feed end.

14. The wireless communication device as claimed in claim 13, wherein the first ground end is perpendicularly connected to an end of the third radiation sheet adjacent to the coupling sheet, the second ground end is perpendicularly connected to the third radiation sheet.

15. The wireless communication device as claimed in claim 9, wherein the housing of the wireless communication device further comprises a second ring portion, the second ring portion comprises two distal ends aligned with the two side portions, and two gaps are respectively defined between each of the two side portions and a corresponding distal end of the second ring portion.

16. A wireless communication device, comprising:

a housing defining two gaps to divide the housing into a first ring portion and a second ring portion spaced from the first ring portion;

a printed circuit board (PCB) surrounded by the second ring portion; and an antenna structure coupled to the PCB, the antenna structure comprising:

a feed end;

a first radiator plate coupled to the feed end;

a second radiator plate;

a third radiator plate coupled to the feed end;

a first ground end disposed on the third radiator plate; and a second ground end disposed on the third radiator plate and spaced from the first ground end;

wherein the first ring portion is coupled to the first radiator plate, the second radiator plate, and the third radiator plate to jointly receive/transmit wireless communication signals.

17. The wireless communication device as claimed in claim 16, wherein the first ring portion comprises a main portion and two side portions symmetrically and perpendicularly connected to two opposite sides of the main portion.

18. The wireless communication device as claimed in claim 17, wherein the first radiator plate comprises a first radiation sheet and a first connection sheet, the first radiation sheet is perpendicularly connected to the feed end and extends parallel to the main portion, a first end of the first connection sheet is connected to a junction of the first radiation sheet and the feed end, and a second end of the first connection sheet is perpendicularly connected to the main portion.

19. The wireless communication device as claimed in claim 18, wherein the second radiator plate comprises a second radiation sheet and a second connection sheet, the second radiation sheet is parallel to the first radiation sheet and extends towards the feed end, and the second connection sheet is perpendicularly connected between the second radiation sheet and the main portion.

20. The wireless communication device as claimed in claim 19, wherein the third radiator plate comprises a third radiation sheet and a coupling sheet extending opposite to the third radiation sheet, the third radiation sheet is perpendicularly connected to one of the two side portions, the coupling sheet is perpendicularly disposed below the feed end.

* * * * *